United States Patent [19]

Champagne

[11] Patent Number: 4,915,271

[45] Date of Patent: Apr. 10, 1990

[54] APPARATUS FOR DRYING ARTICLES OR CLOTHING

[76] Inventor: Laura B. Champagne, 626 Ethel St., Lockport, La. 70374

[21] Appl. No.: 355,801

[22] Filed: May 19, 1989

Related U.S. Application Data

[63] Continuation of Ser. No. 110,378, Oct. 20, 1987, abandoned.

[51] Int. Cl.[4] ..... D06F 59/02; A47G 25/40

[52] U.S. Cl. ..... 223/69; 223/94

[58] Field of Search ..... 223/69, 89, 94, DIG. 3

[56] References Cited

FOREIGN PATENT DOCUMENTS

| | | | |
|---|---|---|---|
| 131170 | 1/1949 | Australia | 223/94 |
| 1080611 | 6/1954 | France | 223/94 |
| 180572 | 1/1936 | Switzerland | 223/94 |
| 388539 | 3/1933 | United Kingdom | 223/94 |
| 586348 | 3/1947 | United Kingdom | 223/94 |
| 755561 | 8/1956 | United Kingdom | 223/94 |
| 1093933 | 12/1967 | United Kingdom | 223/94 |

*Primary Examiner*—Werner H. Schroeder

*Assistant Examiner*—David K. Suto

*Attorney, Agent, or Firm*—Pravel, Gambrell, Hewitt, Kimball & Krieger

[57] ABSTRACT

A garment hanging apparatus comprising a principal vertical body portion having an upper loop at its upper end, and a lower loop at its lower end, the upper and lower loops positioned in perpendicular relationship. Further, substantially along the length of the body portion, there is included a mounting member which has hingedly engaged therewith a pair of arm members which are movable from an vertical upright position to an extended horizontal position. In the use of the apparatus the garment to be dried is slid over the apparatus with the pair of arm members moved completely to the horizontal position and the upper loop portion extending through the neck of the garment so that the arms of the garment is extended outward and the loop serves as a means for hanging the apparatus in position during drying. Following drying, the garment is removed from the apparatus in the reverse action, and the arms are placed in the complete vertical position with the lower loop portion serving as a means to hang the apparatus in storage while the arms are in the vertical state.

8 Claims, 1 Drawing Sheet

APPARATUS FOR DRYING ARTICLES OR CLOTHING

This is a continuation of co-pending application Ser. No. 07/110,378 filed on 10/20/87.

BACKGROUND OF THE INVENTION

1. Field of the Invention

The apparatus of the present invention relates to drying articles of clothing. More particularly, the present invention relates to an apparatus which is so constructed as to facilitate the drying of pull-over garments, particularly, sweater or shirts in their extended state.

2. General Background

In the area of drying clothes, particularly sweaters, they may stretch out of shape due to washing, in the present state of the art, the most practical method of drying such articles yet maintaining their structural integrity, following washing the garment, is to lay the garment out on an absorbant material such as a terry cloth towel or the like, and to allow the garment to dry over a period of time. In most instances, this period of time may involve having the item dry for 2 or 3 days in this state.

One of the shortcomings in attempting to place this type of garment on a hanging item such as a clothes hanger, is that in order to place the clothes hanger in the position on the garment, the arms of the garment must be stretched out of shape vis-a-vis the neck portion, so that the shoulder portions of the hanger may fit properly under the garment. Any type of stretching while the garment is wet, would, of course, result in the dried garment being, in most cases, pulled out of shape in an undesirable shape.

Therefore, there is a need for an apparatus which would assist in the drying of a garment while in the hanging state, yet not result in arm and shoulder portions of the garment being stretched out of shape in order to undertake such a task.

In the state of the art there have been several U.S. patents granted which addresses the hanging of clothes, the most pertinent being listed as follows.

| U.S. PAT. NO. | INVENTOR | TITLE |
|---|---|---|
| 735,443 | Baer | "Coat Hanger" |
| 1,193,356 | Buxton | "Garment Hanger" |
| 1,193,357 | Buxton | "Garment Hanger" |
| 2,290,722 | Weingarten | "Collapsible Garment Hanger" |
| 3,719,312 | Krut | "Collapsible Garment Hanger" |
| 3,334,793 | Anderson | "Hanger" |
| 4,117,960 | Bengsch, et al | "Folding Clothes-Hanger" |
| 4,186,857 | Helms, Jr. | "Collapsible Coat Hanger" |
| 2,448,234 | Pandele | "Garment Hanger" |

SUMMARY OF THE PRESENT INVENTION

The apparatus of the present invention solves the problems in the art in a simple and straight forward manner. What is provided is a garment hanging apparatus comprising a principal vertical body portion having a first loop at its upper end, and a second loop at its lower end, the first and second loops positioned in perpendicular relationship. Further, substantially along the length of the body portion there is included a mounting member which has hingedly engaged a pair of arm members which are movable from an vertical upright position to an extended horizontal position. In the use of the apparatus, the garment to be dried is slid over the apparatus with a pair of arm members moved complete to the horizontal position and the first loop portion extending through the neck of the garment so that the arms of the garment are extended outward and the first loop serves as a means for hanging the apparatus in position during drying. Following drying, the garment is removed from the apparatus in the reverse action, and the arms are placed to the complete vertical position, the apparatus inverted, with the second loop portion serving as a means to hang the apparatus in storage while the arms are in the vertical state.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 4 illustrates the apparatus in position hanging from a shelf or the like; and FIG. 5 illustrates the apparatus of the present invention in storage hanging from a hook or the like.

DETAILED DESCRIPTION OF THE PREFERRED EMBODIMENT

Figure 5:
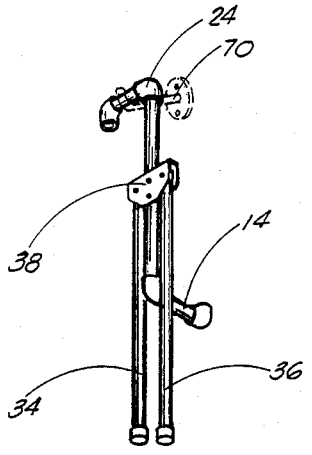

FIGS. 1–5 illustrate the preferred embodiment of the apparatus of the present invention by the numeral 10. As seen in the Figures, apparatus 10 provides an apparatus for hanging garments such as a sweater or a shirt when the apparatus is in the extended state. As seen in the Figures, apparatus 10 comprises a substantially upright vertical body portion 12 preferably constructed of a light-weight tubular plastic as is the arm and loop portions of the apparatus as will be discussed further. Vertical body portion 12 includes an first loop portion 14 which is adapted with a first elbow joint 16, a first horizontal arm member 18, and a second elbow joint 20. The configuration is attached to the upper most end 22 of vertical body portion 12 to serve as a means for hanging the apparatus when the apparatus has a garment placed upon as will be discussed further. Further on the lower end portion of vertical body portion 12, there is a similar second loop member 24 likewise attached to the lower end 26 of vertical body portion 12 via a first elbow joint 28, a second horizontal body member 30, and a second elbow joint 32, this configuration serving as a means for storing the apparatus when the apparatus is in the closed and inverted position as seen in FIG. 5.

For purposes of structure, and to facilitate the use of the hanging of the apparatus both in the extended and in the storage position, first loop member 14 and second loop member 24 are positioned perpendicular to one another as seen in the Figures.

Figure 3:
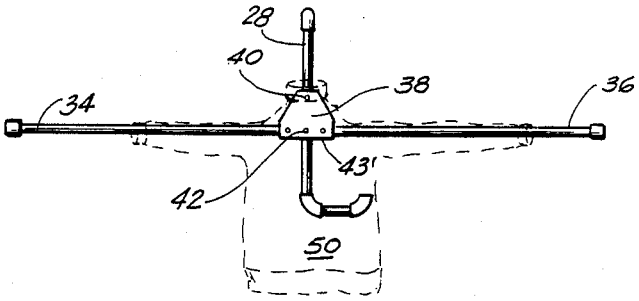
FIG. 3 illustrates a view of the apparatus of the present invention with a garment hanging thereupon.
Figure 4:
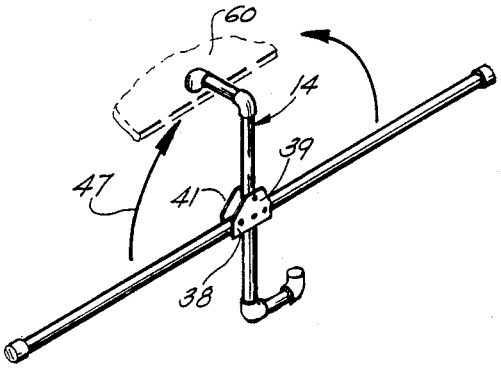

Apparatus 10 further includes means for positioning the arms of the garment as the garment is placed upon apparatus 10. This means includes a pair of elongated arm members 34 and 36, respectively, which are hingedly engaged to a centrally located bracket 38, the bracket 38 rigidly attached approximately midway along vertical body member 12 via a pair of mounting screws 40 and 42, with bracket 38 having a pair of face members 39 and 41 with a traveling space 42 therebetween to accommodate the movement of the arms 34 and 36 between the upper vertical position and the extended horizontal position as seen in FIGS. 3 and 4. In addition, bracket member 38 further includes a base portion 43 which disallows hingedly engaged arm members 34 and 36 from traveling below the horizontal distance as seen in FIGS. 3 and 4, and may move only from the horizontal position to the complete vertical position as indicated by arrows 47 in FIG. 4.

Figure 1:
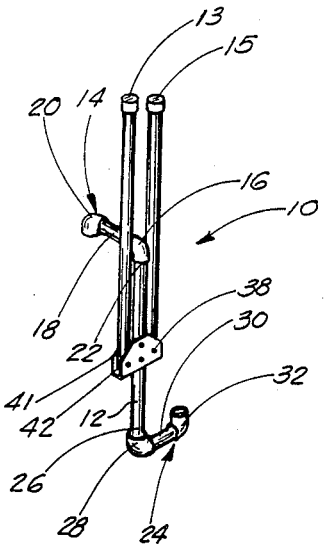
FIG. 1 illustrates an overall view of the apparatus of the present invention in the closed position.
Figure 2:
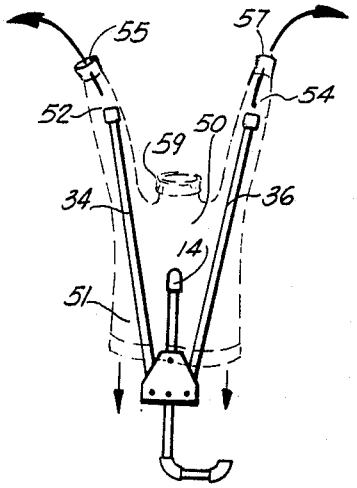
FIG. 2 illustrates a view of the apparatus as a garment is being placed thereupon.

As seen in its initial use, apparatus 10 would be in the closed position in FIG. 1. Upon positioning of a wet garment 50 as seen in FIG. 2, arm members 34 and 36 of apparatus 10 would be extended slightly outwardly to accommodate the lower body portion 51 of garment 50 and therefore the upper end portions 13 and 15 of arm members 34 and 36, respectively, would be lead into the arms 52 and 54 of garment 50, without having to stretch the arms out of shape vis-a-vis the configuration of the body portion 51. As the end portions 13 and 15 have traveled through the outlets 55 and 57 of arms 52 and 54, respectively, the arm members of the apparatus may be placed in the horizontal position as seen in FIG. 3, with the first loop portion 14 extending out from the neck 59 of garment 50, so that the garment is in the total hanging position as seen in FIG. 3, and so that the upper loop portion 14 may be utilized to hang the apparatus on a shelf 60 as seen in FIG. 4, with the garment positioned thereupon for drying.

Therefore, following the drying of garment 50, the process by which the garment 50 was placed on apparatus 10 would be reversed, with the garment being pulled from the apparatus as could be seen in FIG. 2, and the apparatus would return to the closed configuration as seen in FIG. 1. After the apparatus is closed, the apparatus could be inserted to its position so that the second loop portion 24 would be placed in the upright position as seen in FIG. 5, to be engaged upon a hook 70 during storage, so that the arm members 34 and 36 would remain in the closed vertical position, facing downward, with first loop portion likewise positioned in the down mode as seen in FIG. 5. Therefore, the apparatus could be alternated from the upright position for usage as seen in FIG. 3, and inserted to be placed in the storage mode as seen in FIG. 5.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What I claim is:

1. An apparatus for hanging articles of clothing, having neck and arm portions, the apparatus comprising:

a. an elongated body portion;

b. first and second loop portions attached to first and second ends of the elongated body portion;

c. a pair of arm members hingedly engaged to the elongated body portion for moving from a first storage position in parallel relation to the body portion, to a second garment support position perpendicular to the body portion;

d. means for allowing a garment, having arm portions and a neck portion, to be placed upon the apparatus while the pair of arm members are moved from the first position parallel to the body portion, to the extended perpendicular position so that upon positioning of the garment on the apparatus, the pair of arm members extend through and beyond the ends of the arms of the garment in perpendicular relationship to the body portion, and the first loop portion extends out of the neck of the garment, for hanging the apparatus while the garment dries; and e. upon removing the garment from the apparatus, the second loop portion providing a means for storing the apparatus in the inverted position while the pair of arm members are in the first position in parallel relation to the body portion.

2. The apparatus of claim 1, wherein the pair of arm members, move from the vertical position to the horizontal position allowing placement of the garment onto the apparatus without disfiguring the garment in the process.

3. The apparatus of claim 1, wherein the arm members and body portion are constructed of a light-weight tubular plastic.

4. The apparatus of claim 1, wherein the first loop portion and the second loop portion are arranged in a configuration perpendicular to one another.

5. The apparatus in claim 1, wherein there is further provided a bracket member engaged upon the body portion for allowing the arm members to rotate from the vertical to the horizontal position for accommodating a garment thereupon.

6. An apparatus for hanging articles of clothing, the articles of clothing having a body portion, a neck portion, and a pair of sleeves, the apparatus comprising:

a. an first elongated body member, having a first upper loop portion on its upper end and a second lower loop portion on its lower end;

b. a bracket member rigidly engaged to the body member substantially along its midway portion; and c. first and second arm members hingedly engaged in the bracket member, for moving from a first vertical storage position aligned with the first elongated body member, to a second horizontal position perpendicular to the first elongated body member, to provide means for sliding through and extending beyond the ends of the sleeves of the garment as the arm members are moved to a position intermediate the vertical and the horizontal positions, and the upper loop portion defines means for extending into the neck of the garment to hang the apparatus while the garment is fixed upon the apparatus for drying; and the second lower loop portion defining means to hang the apparatus in an inward storage position when a garment has been removed therefrom, with the arms in the first vertical storage position.

7. The apparatus in claim 6, wherein the first and second arm members are moved to the complete horizontal position while engaged through the sleeves of the garment.

8. The apparatus in claim 6, wherein the first upper loop portion and the second lower loop portion are configured in a perpendicular relation to one another for storage and for supporting a garment thereupon.

* * * * *